US008430159B2

(12) United States Patent
Van Nieuwkoop

(10) Patent No.: US 8,430,159 B2
(45) Date of Patent: Apr. 30, 2013

(54) METHOD OF EXPANDING A TUBULAR ELEMENT IN A WELLBORE

(75) Inventor: Pieter Van Nieuwkoop, Rijswijk (NL)

(73) Assignee: Shell Oil Company, Houston, TX (US)

( * ) Notice: Subject to any disclaimer, the term of this patent is extended or adjusted under 35 U.S.C. 154(b) by 345 days.

(21) Appl. No.: 12/747,081

(22) PCT Filed: Dec. 11, 2008

(86) PCT No.: PCT/EP2008/067294

§ 371 (c)(1),
(2), (4) Date: Jun. 9, 2010

(87) PCT Pub. No.: WO2009/074633

PCT Pub. Date: Jun. 18, 2009

(65) Prior Publication Data

US 2010/0263878 A1 Oct. 21, 2010

(30) Foreign Application Priority Data

Dec. 13, 2007 (EP) ..... 07123104

(51) Int. Cl.
*E21B 17/00* (2006.01)

(52) U.S. Cl.
USPC ..... 166/242.2; 175/171

(58) Field of Classification Search ..... 166/242.2, 166/207, 212; 175/171
See application file for complete search history.

(56) References Cited

U.S. PATENT DOCUMENTS

2004/0045617 A1 3/2004 Kamiyama et al. ..... 138/98
2005/0172710 A1 * 8/2005 Keller ..... 73/152.41

FOREIGN PATENT DOCUMENTS

| | | |
|---|---|---|
| EP | 0044706 | 1/1982 |
| GB | 2467242 | 7/2010 |
| GB | 2469399 | 11/2011 |
| WO | WO9716301 | 5/1997 |
| WO | WO03036025 | 5/2003 |
| WO | WO2004007893 | 1/2004 |
| WO | WO 2008006841 A1 * | 1/2008 |

* cited by examiner

*Primary Examiner* — Daniel P Stephenson
*Assistant Examiner* — Ronald Runyan

(57) ABSTRACT

A method of radially expanding a tubular element in a wellbore formed in an earth formation comprises arranging the tubular element in the wellbore such that a lower end portion of the wall of the tubular element extends radially outward and in an axially reverse direction so as to form an expanded tubular section extending around a remaining tubular section of the tubular element, whereby an annulus is defined between said expanded and remaining tubular sections, and axially extending the expanded tubular section by moving the remaining tubular section downward relative to the expanded tubular section so that said lower end portion of the wall bends radially outward and in an axially reverse direction. A diameter of the expanded tubular section is controlled by controlling a fluid pressure in the annulus.

9 Claims, 4 Drawing Sheets

METHOD OF EXPANDING A TUBULAR ELEMENT IN A WELLBORE

PRIORITY CLAIM

The present application claims priority to PCT Application EP2008/067294, filed 11 Dec. 2008, which in turn claims priority from European Application EP07123104.7, filed 13 Dec. 2007.

TECHNICAL FIELD OF THE INVENTION

The present invention relates to a method of radially expanding a tubular element in a wellbore formed into an earth formation.

BACKGROUND OF THE INVENTION

The technology of radially expanding tubular elements in wellbores finds increasing application in the industry of oil and gas production from subterranean formations. Wellbores are generally provided with one or more casings or liners to provide stability to the wellbore wall, and/or to provide zonal isolation between different earth formation layers. The terms "casing" and "liner" refer to tubular elements for supporting and stabilising the wellbore wall, whereby it is generally understood that casing extends from surface into the wellbore and that a liner extends from a certain depth further into the wellbore. However, in the context of this disclosure the terms "casing" and "liner" are used interchangeably and without such intended distinction.

In conventional wellbore construction, several casings are installed at different depth intervals, in a nested arrangement, whereby each subsequent casing is lowered through the previous casing and therefore has a smaller diameter than the previous casing. As a result, the cross-sectional wellbore size that is available for oil and gas production, decreases with depth. To alleviate this drawback, it has become general practice to radially expand one or more tubular elements at the desired depth in the wellbore, for example to form an expanded casing, expanded liner, or a clad against an existing casing or liner. Also, it has been proposed to radially expand each subsequent casing to substantially the same diameter as the previous casing to form a monobore wellbore. It is thus achieved that the available diameter of the wellbore remains substantially constant along (a portion of) its depth as opposed to the conventional nested arrangement.

EP 1438483 B1 discloses a system for expanding a tubular element in a wellbore whereby the tubular element, in unexpanded state, is initially attached to a drill string during drilling of a new wellbore section.

To expand such wellbore tubular element, generally a conical expander is used with a largest outer diameter substantially equal to the required tubular diameter after expansion. The expander is pumped, pushed or pulled through the tubular element. Such method can lead to high friction forces between the expander and the tubular element. Also, there is a risk that the expander becomes stuck in the tubular element.

EP 0044706 A2 discloses a flexible tube of woven material or cloth that is expanded in a wellbore by eversion to separate drilling fluid pumped into the wellbore from slurry cuttings flowing towards the surface.

However there is a need for an improved method of radially expanding a tubular element in a wellbore.

SUMMARY OF THE INVENTION

In accordance with the invention there is provided a method of radially expanding a tubular element in a wellbore formed in an earth formation, the method comprising:

a) arranging the tubular element in the wellbore whereby a lower end portion of the wall of the tubular element extends radially outward and in axially reverse direction so as to form an expanded tubular section extending around a remaining tubular section of the tubular element, whereby an annulus is defined between said expanded and remaining tubular sections;

b) axially extending the expanded tubular section by moving the remaining tubular section downward relative to the expanded tubular section so that said lower end portion of the wall bends radially outward and in axially reverse direction; and c) controlling a diameter of the expanded tubular section by controlling a fluid pressure in the annulus.

By moving the remaining tubular section downward relative to the expanded tubular section, the tubular element is effectively turned inside out whereby the tubular element is progressively expanded without the need for an expander that is pushed, pulled or pumped through the tubular element. The expanded tubular section can form a casing or liner in the wellbore.

Furthermore, it was found that the diameter of the expanded tubular section can be controlled by controlling the fluid pressure in the annulus. For example, the diameter of the expanded tubular section can be adapted to variations of the wellbore diameter by varying the fluid pressure in the annulus. The diameter of the expanded tubular section decreases for increasing fluid pressure in the annulus during the eversion process, and increases for decreasing fluid pressure in the annulus during the eversion process. It is believed that this effect is caused by a tendency of the lower end portion of the wall to bend slightly radially inward just before bending radially outward and in axially reverse direction, at relatively high fluid pressures in the annulus.

Preferably the fluid pressure in the annulus is controlled simultaneously with moving the remaining tubular section downward relative to the expanded tubular section.

Suitably the fluid pressure in the annulus is increased to decrease said diameter of the expanded tubular section, or the fluid pressure in the annulus is decreased to increase said diameter of the expanded tubular section.

In order to achieve adequate sealing of the expanded tubular section relative to the wellbore wall, suitably an outer surface of the expanded tubular section is subjected to a wellbore fluid pressure, wherein step c) comprises controlling the fluid pressure in the annulus to be larger than the wellbore fluid pressure.

Suitably step c) comprises subjecting the fluid pressure in the annulus to a pressure variation so as to create a portion of the expanded tubular section that is expanded against the wellbore wall and is sealed relative to the wellbore wall.

To create a portion of the expanded tubular section of increased diameter relative to a remainder portion of the expanded tubular section, preferably the pressure variation comprises a temporary decrease of the fluid pressure to below the wellbore fluid pressure.

In order to achieve that the expanded tubular section retains its expanded form, it is preferred that the wall of the tubular element includes a material that is plastically deformed in the bending zone, so that the expanded tubular section automatically remains expanded as a result of said plastic deformation. Plastic deformation refers in this respect to permanent deformation, as occurring during deformation of various ductile metals upon exceeding the yield strength of the material. Thus, there is no need for an external force or pressure to maintain the expanded form. If, for example, the expanded tubular section has been expanded against the wellbore wall as a result of said bending of the wall, no external radial force or pressure needs to be exerted to the expanded tubular section to keep it against the wellbore wall. Suitably the wall of the tubular element is made of a metal such as steel or any other ductile metal capable of being plastically deformed by eversion of the tubular element. The expanded tubular section then has adequate collapse resistance, for example in the order of 100-150 bars.

In order to induce said movement of the remaining tubular section, preferably the remaining tubular section is subjected to an axially compressive force acting to induce said movement. The axially compressive force preferably at least partly results from the weight of the remaining tubular section. If necessary the weight can be supplemented by an external, downward, force applied to the remaining tubular section to induce said movement. As the length, and hence the weight, of the remaining tubular section increases, an upward force may need to be applied to the remaining tubular section to prevent uncontrolled bending or buckling in the bending zone.

BRIEF DESCRIPTION OF THE DRAWINGS

The invention will be described hereinafter in more detail and by way of example, with reference to the accompanying drawings in which.

In the drawings and the description, like reference numerals relate to like components.

DETAILED DESCRIPTION OF THE PREFERRED EMBODIMENTS

Figure 1:
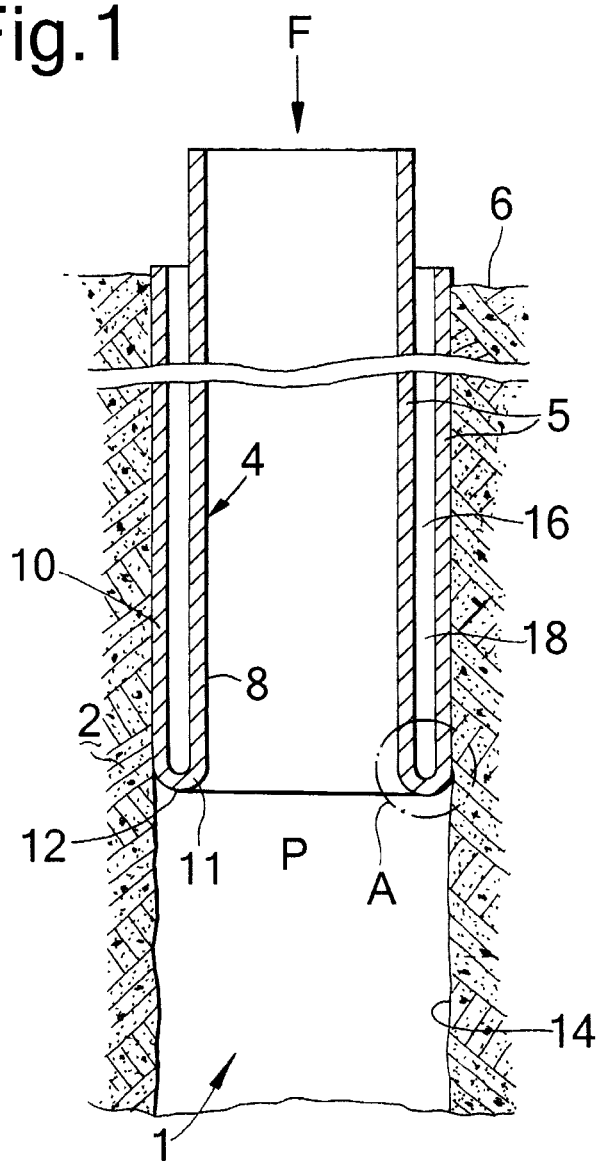
FIG. 1 schematically shows an embodiment of a wellbore system used with the method of the invention, including an unexpanded section and an expanded section of a wellbore liner.

Referring to FIG. 1 there is shown a wellbore system whereby a wellbore 1 extends into an earth formation 2, and a tubular element in the form of liner 4 extends from surface downwardly into the wellbore 1. The liner 4 has been partially radially expanded by eversion of its wall 5 whereby a radially expanded tubular section 10 of the liner 4 has been formed of outer diameter substantially equal to the wellbore diameter. A remaining tubular section of the liner 4, in the form of unexpanded liner section 8, extends from surface 6 concentrically into the expanded tubular section 10.

The wall 5 of the liner 4 is, due to eversion at its lower end, bent radially outward and in axially reverse (i.e. upward) direction so as to form a U-shaped lower section 11 of the wall 5 interconnecting the unexpanded liner section 8 and the expanded liner section 10. The U-shaped lower section 11 of the liner 4 defines a bending zone 12 of the liner.

The expanded liner section 10 is axially fixed to the wellbore wall 14 by virtue of frictional forces between the expanded liner section 10 and the wellbore wall 14 resulting from the expansion process. Alternatively, or additionally, the expanded liner section 10 can be anchored to the wellbore wall by any suitable anchoring means (not shown).

The expanded tubular section 10 and the remaining tubular section 8 define an annulus 16 there between, the annulus 16 containing a body of fluid 18 at elevated fluid pressure.

Figure 2:
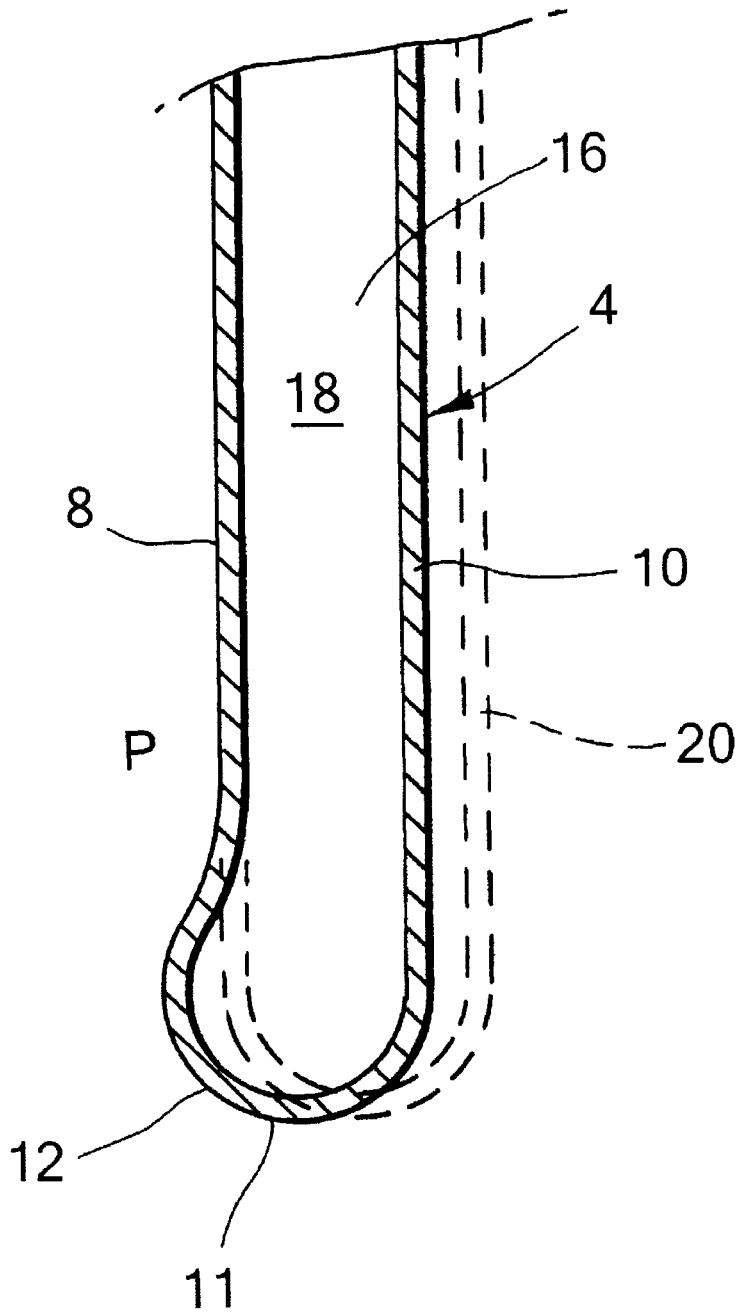
FIG. 2 schematically shows detail A of FIG. 1.

Referring further to FIG. 2 there is shown detail A of FIG. 1, whereby the solid lines indicate the actual shape of U-shaped lower section 11, and whereby the dotted lines indicate an imaginary shape 20 of the U-shaped lower section 11 at a reduced fluid pressure in the annulus 16. The fluid pressure in the wellbore 1, indicated by "P", acts on the inner surface of the unexpanded liner section 8 and the outer surface of the expanded liner section 10.

Figure 3:
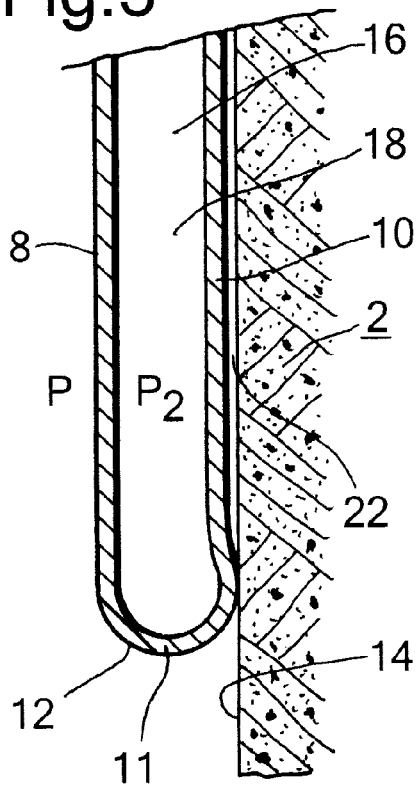
FIG. 3 schematically shows detail A at relatively low pressure in an annulus between the expanded and unexpanded liner sections.

Referring further to FIG. 3 there is shown detail A of FIG. 1 while the fluid pressure in the body of fluid 18 is lower than the wellbore fluid pressure P. A small annular gap 22 is present between the expanded liner section 10 and the wellbore wall 14.

Figure 4:
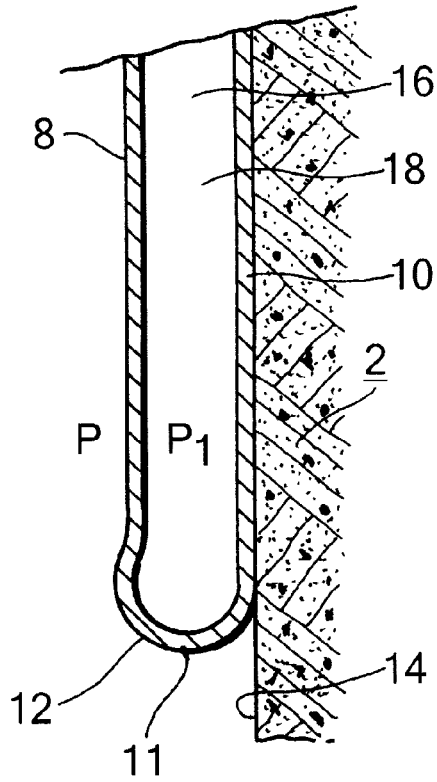
FIG. 4 schematically shows detail A at relatively high pressure in the annulus.

Referring further to FIG. 4 there is shown detail A of FIG. 1 while the fluid pressure in the body of fluid 18 is higher than the wellbore fluid pressure P. The annular gap 22 has vanished.

Figure 5:
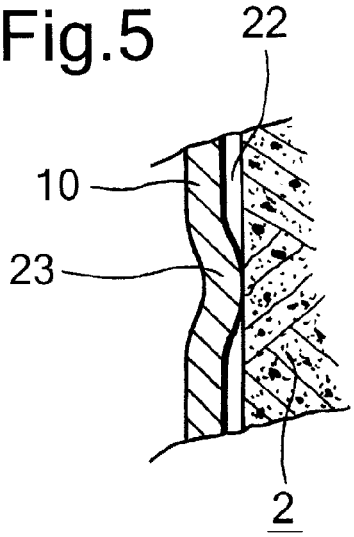
FIG. 5 schematically shows an outwardly bulging portion of the expanded liner section.

In FIG. 5 is shown a radially outward bulging portion 23 of expanded liner section 10.

Figure 6:
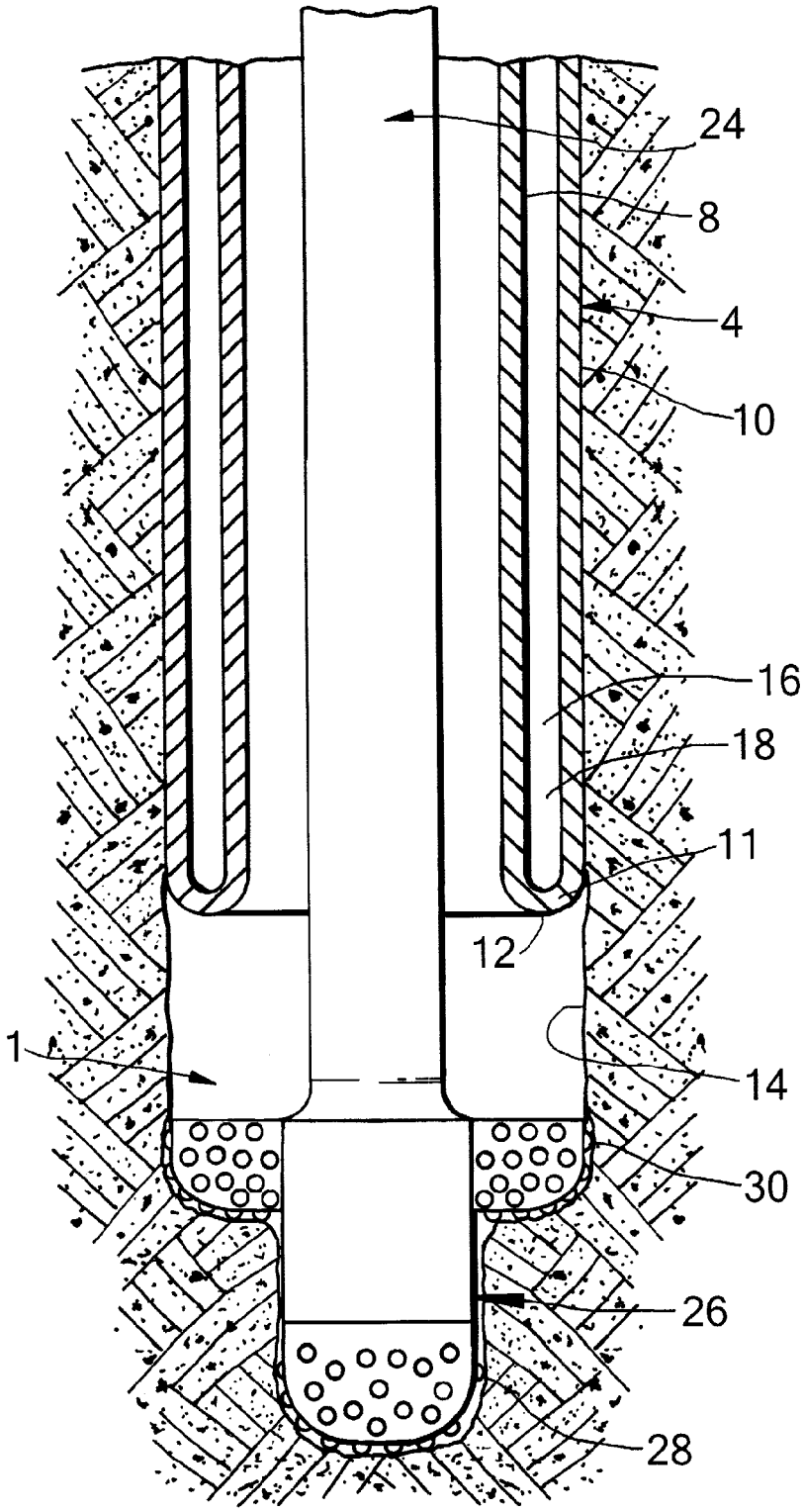
FIG. 6 schematically shows the embodiment of FIG. 1 modified in that a drill string extends through the expanded liner section.

In FIG. 6 is shown the modified embodiment whereby a drill string 24 extends from surface 6 through the unexpanded liner section 8 to the bottom of the wellbore 1. The drill string 24 is at its lower end provided with a drill bit 26 comprising a pilot bit 28 with gauge diameter slightly smaller than the internal diameter of the unexpanded liner section 8, and a reamer section 30 with gauge diameter adapted to drill the wellbore 1 to its nominal diameter. The reamer section 30 is radially retractable to an outer diameter allowing it to pass through unexpanded liner section 8, so that the drill string 20 can be retrieved through the unexpanded liner section 8 to surface.

During normal operation of the embodiment of FIGS. 1-5, a lower end portion of the liner 4 is initially everted. That is, the lower portion is bent radially outward and in axially reverse direction. The U-shaped lower section 11 and the expanded liner section 10 are thereby initiated. Subsequently, the short length of expanded liner section 10 that has been formed is anchored to the wellbore wall by any suitable anchoring means. Depending on the geometry and/or material properties of the liner 4, the expanded liner section 10 alternatively can become anchored to the wellbore wall automatically due to friction between the expanded liner section 10 and the wellbore wall 14.

The unexpanded liner section 8 is then gradually moved downward by application of a sufficiently large downward force thereto, whereby the unexpanded liner section 8 becomes progressively everted in the bending zone 12. In this manner the unexpanded liner section 8 is progressively transformed into the expanded liner section 10. The bending zone 12 moves in downward direction during the eversion process, at approximately half the speed of the unexpanded liner section 8.

Since the length, and hence the weight, of the unexpanded liner section 8 gradually increases, the magnitude of the downward force can be gradually lowered in correspondence with the increasing weight of liner section 8. As the weight increases, the downward force eventually may need to be replaced by an upward force to prevent buckling of liner section 8.

Simultaneously with downward movement of the unexpanded liner section 8, the fluid pressure in the annulus 16 is maintained at a pressure $P_1$ higher than the wellbore fluid pressure P.

The diameter and/or wall thickness of the liner 4 are selected such that, with the fluid pressure in the annulus at level $P_1$, the expanded liner section 10 becomes slightly pressed against the wellbore wall 14 as a result of the eversion process so as to form a seal against the wellbore wall 14 and/or to stabilize the wellbore wall (FIG. 4)

At regular intervals during the eversion process, the fluid pressure in the annulus 16 is temporarily lowered to a pressure $P_2$ lower than the wellbore fluid pressure P. During each such interval, the U-shaped lower wall section 11 moves radially outward due to the decreased fluid pressure in the annulus 16 whereby the expanded liner section 10 becomes more firmly pressed against the wellbore wall 14. After eversion of a short liner section at fluid pressure $P_2$ in the annulus 16, the fluid pressure in the annulus is increased again to pressure $P_1$. As a result the radially outward bulging portion 23 (FIG. 5) is formed for each such interval, thereby providing enhanced sealing between the expanded liner section 10 and the wellbore wall 14.

Normal operation of the modified embodiment (FIG. 6) is substantially similar to normal operation of the embodiment of FIGS. 1-5, except with regard to the following. Simultaneously with downward movement of the unexpanded liner section 8 into the wellbore, the drill string 24 is operated to rotate the drill bit 26 whereby the pilot bit 28 drills an initial portion of the borehole and the reamer section 30 enlarges the borehole to the final gauge diameter. The drill string 24 thereby gradually moves downward into the wellbore 1. The unexpanded liner section 8 is moved downward in a controlled manner and at substantially the same speed as the drill string 24, so that it is ensured that the bending zone 12 remains at a short distance above the drill bit 26. Controlled lowering of the unexpanded liner section 8 can be achieved, for example, by controlling the downward force, or upward force, referred to hereinbefore. Suitably, the unexpanded liner section 8 is supported by the drill string 24, for example by bearing means (not shown) connected to the drill string, which supports the U-shaped lower section 11. In that case the upward force is suitably applied to the drill string 24 and transmitted via the bearing means to the unexpanded liner section 8. Furthermore, at least a portion of the weight of the unexpanded liner section 8 can be transferred to the drill string 24 by the bearing means, so as to provide a thrust force to the drill bit 26.

The fluid pressure in the annulus 16 provides a downward force to the unexpanded liner section 8, which can be transferred to the drill string 24 by the bearing means in order to provide a thrust force to the drill bit 26. Since the fluid pressure in the annulus can be accurately controlled, the thrust force provided by the fluid pressure in the annulus 16 also can be accurately controlled.

When it is required to retrieve the drill string 24 to surface, for example when the drill bit 26 is to be replaced or when drilling of the wellbore 1 is complete, the reamer section 30 brought to its radially retracted mode. Subsequently the drill string 24 is retrieved through the unexpanded liner section 8 to surface.

Experiments have shown that the annular gap 22 vanishes if the fluid pressure in the annulus 16 is relatively high. In view thereof, in an alternative embodiment the U-shaped lower wall section 11 is provided with restraining means, such as a metal ring positioned against the inner surface of U-shaped wall section 11, in order to prevent radially inward movement of the U-shaped wall section 11. When the fluid pressure in the annulus 16 is increased to pressure $P_1$ or beyond, with the restraining means in place, the U-shaped wall section 11 is prevented from moving radially inward, and annular gap 22 vanishes.

With the wellbore system of the invention, it is achieved that the wellbore is progressively lined with the everted liner directly above the drill bit during the drilling process. As a result, there is only a relatively short open-hole section of the wellbore during the drilling process at all times. The advantages of such short open-hole section will be most pronounced during drilling into a hydrocarbon fluid containing layer of the earth formation. In view thereof, for many applications it will be sufficient if the process of liner eversion during drilling is applied only during drilling into the hydrocarbon fluid reservoir, while other sections of the wellbore are lined or cased in conventional manner. Alternatively, the process of liner eversion during drilling may be commenced at surface or at a selected downhole location, depending on circumstances.

In view of the short open-hole section during drilling, there is a significantly reduced risk that the wellbore fluid pressure gradient exceeds the fracture gradient of the rock formation, or that the wellbore fluid pressure gradient drops below the pore pressure gradient of the rock formation. Therefore, considerably longer intervals can be drilled at a single nominal diameter than in a conventional drilling practice whereby casings of stepwise decreasing diameter must be set at selected intervals.

Also, if the wellbore is drilled through a shale layer, such short open-hole section eliminates possible problems due to a heaving tendency of the shale.

After the wellbore has been drilled to the desired depth and the drill string has been removed from the wellbore, the length of unexpanded liner section that is still present in the wellbore can be left in the wellbore or it can be cut-off from the expanded liner section and retrieved to surface. In case the length of unexpanded liner section is left in the wellbore, there are several options for completing the wellbore. These are, for example, as outlined below.

A) A fluid, for example brine, is pumped into the annulus between the unexpanded and expanded liner sections so as to pressurise the annulus and increase the collapse resistance of the expanded liner section. Optionally one or more holes are provided in the U-shaped lower section to allow the pumped fluid to be circulated.

B) A heavy fluid is pumped into the annulus so as to support the expanded liner section and increase its collapse resistance.

C) Cement is pumped into the annulus in order to create, after hardening of the cement, a solid body between the unexpanded liner section and the expanded liner section, whereby the cement may expand upon hardening.

D) The unexpanded liner section is radially expanded (i.e. clad) against the expanded liner section, for example by pumping, pushing or pulling an expander through the unexpanded liner section.

In the above examples, expansion of the liner is started at surface or at a downhole location. In case of an offshore wellbore whereby an offshore platform is positioned above the wellbore, at the water surface, it can be advantageous to start the expansion process at the offshore platform. In such process, the bending zone moves from the offshore platform to the seabed and from there further into the wellbore. Thus, the resulting expanded tubular element not only forms a liner in the wellbore, but also a riser extending from the offshore platform to the seabed. The need for a separate riser is thereby obviated.

Furthermore, conduits such as electric wires or optical fibres for communication with downhole equipment can be extended in the annulus between the expanded and unexpanded sections. Such conduits can be attached to the outer surface of the tubular element before expansion thereof. Also, the expanded and unexpanded liner sections can be used as electricity conductors to transfer data and/or power downhole.

Since any length of unexpanded liner section that is still present in the wellbore after completion of the eversion process, will be subjected to less stringent loading conditions than the expanded liner section, such length of unexpanded liner section may have a smaller wall thickness, or may be of lower quality or steel grade, than the expanded liner section. For example, it may be made of pipe having a relatively low yield strength or relatively low collapse rating.

Instead of leaving a length of unexpanded liner section in the wellbore after the expansion process, the entire liner can be expanded with the method described above so that no unexpanded liner section remains in the wellbore. In such case, an elongate member, for example a pipe string, can be used to exert the necessary downward force to the unexpanded liner section during the last phase of the expansion process.

In order to reduce friction forces between the unexpanded and expanded liner sections during the expansion process, suitably a friction-reducing layer, such as a Teflon layer, is applied between the tube and the unexpanded and expanded liner sections. For example, a friction reducing coating can be applied to the outer surface of the liner before expansion, or to the inner and/or outer surface of the tube.

Instead of expanding the expanded liner section against the wellbore wall (as explained in the detailed description), the expanded liner section can be expanded against the inner surface of another tubular element already present in the wellbore.

The invention claimed is:

1. A method of radially expanding a tubular element in a wellbore formed in an earth formation, the method comprising:

a) arranging the tubular element in the wellbore such that a lower end portion of the wall of the tubular element extends radially outward and in an axially reverse direction so as to form an expanded tubular section extending around a remaining tubular section of the tubular element, whereby an annulus is defined between said expanded and remaining tubular sections;

b) axially extending the expanded tubular section by moving the remaining tubular section downward relative to the expanded tubular section so that said lower end portion of the wall bends radially outward and in an axially reverse direction; and c) controlling a diameter of the expanded tubular section by controlling a fluid pressure in the annulus, wherein the fluid pressure in the annulus is controlled simultaneously with moving the remaining tubular section downward relative to the expanded tubular section;

wherein an outer surface of the expanded tubular section is subjected to a wellbore fluid pressure, and wherein step c) comprises controlling the fluid pressure in the annulus to be larger than the wellbore fluid pressure and subjecting the fluid pressure in the annulus to a pressure variation so as to create a portion of the expanded tubular section that is expanded against the wellbore wall and is sealed relative to the wellbore wall, wherein the pressure variation comprises a decrease of the fluid pressure to below the wellbore fluid pressure.

2. The method of claim 1 wherein the fluid pressure in the annulus is decreased so as to decrease said diameter of the expanded tubular section.

3. The method of claim 1 wherein the fluid pressure in the annulus is increased so as to increase said diameter of the expanded tubular section.

4. The method of claim 1 wherein the tubular element is provided with restraining means arranged to restrict radially inward movement of said lower end portion of the wall.

5. The method of claim 1 wherein a drill string is operated to further drill the wellbore, the drill string extending through the remaining tubular section.

6. The method of claim 5, wherein the drill string is operated simultaneously with lowering the remaining tubular section in the wellbore.

7. The method of claim 1 wherein the wall of the tubular element includes a material subject to plastic deformation during said bending of the wall so that the expanded tubular section retains an expanded shape as a result of said plastic deformation.

8. The method of claim 1 wherein the remaining tubular section is subjected to an axially compressive force inducing said downward movement of the remaining tubular section.

9. The method of claim 8, wherein said axially compressive force at least partly results from the weight of the remaining tubular section.

* * * * *